US007793367B1

(12) United States Patent
Ruiter et al.

(10) Patent No.: US 7,793,367 B1
(45) Date of Patent: Sep. 14, 2010

(54) FURNITURE POST AND COUPLER

(75) Inventors: Joel Ruiter, Grand Rapids, MI (US); Mark Chamberlin, Delton, MI (US); Gregory J. Winer, Kentwood, MI (US)

(73) Assignee: R.T. London Company, Grand Rapids, MI (US)

( * ) Notice: Subject to any disclaimer, the term of this patent is extended or adjusted under 35 U.S.C. 154(b) by 48 days.

(21) Appl. No.: 12/013,035

(22) Filed: Jan. 11, 2008

Related U.S. Application Data

(60) Provisional application No. 60/885,085, filed on Jan. 16, 2007.

(51) Int. Cl.
*A47C 19/00* (2006.01)

(52) U.S. Cl. ..... 5/282.1; 5/2.1; 5/9.1

(58) Field of Classification Search ..... 5/2.1, 5/8, 9.1, 282.1
See application file for complete search history.

(56) References Cited

U.S. PATENT DOCUMENTS

| | | | | | |
|---|---|---|---|---|---|
| 4,064,996 | A * | 12/1977 | Shillum | 211/191 |
| 5,481,842 | A * | 1/1996 | Gautreau | 52/656.9 |
| 5,522,101 | A * | 6/1996 | Yeh | 5/9.1 |
| 5,572,751 | A * | 11/1996 | Brandt | 5/9.1 |
| 6,478,501 | B1 * | 11/2002 | Kahl | 403/255 |
| 6,675,409 | B1 * | 1/2004 | O'Dell, Jr. | 5/9.1 |

* cited by examiner

*Primary Examiner*—Fredrick Conley
(74) *Attorney, Agent, or Firm*—McGarry Bair PC

(57) ABSTRACT

A rigid furniture post comprises a single piece of extruded material formed into any number of shapes which may serve as a post for furniture. A coupler comprises a piece of thermoplastic containing at least one female side wherein a post may be inserted to facilitate in the linear assembling of post segments into a longer post.

12 Claims, 15 Drawing Sheets

FURNITURE POST AND COUPLER

CROSS-REFERENCE TO RELATED APPLICATION

This application claims the benefit of U.S. provisional application Ser. No. 60/885,085, filed Jan. 16, 2007, which is incorporated herein in its entirety.

BACKGROUND OF THE INVENTION

1. Field of the Invention

The invention relates to furniture and more particularly to the structure and fabrication of posts and couplers used in the assembly of furniture pieces such as beds.

2. Description of the Related Art

Case goods sold to institutions such as schools and colleges often include beds comprising wooden headboards and metal bed frames. The term "headboards" typically includes both headboards and footboards, since they are often identical at least in dimension. Consequently, beds can optionally be stacked atop one another to form bunk beds and save space. Also, in colleges especially, it is common to mount the headboards on extenders so that the bed will be elevated, providing space beneath the bed for desks, chairs and the like.

Wooden headboards are typically fabricated from two posts and at least one crosspiece extending between the posts. The crosspiece is joined to the posts by doweling and gluing or by mortise and tenon joints. Under normal use, this ancient construction serves adequately, but with heavy institutional use and with changes in climate (e.g., temperature and humidity), it is not uncommon for the joints to loosen. This will typically increase maintenance costs and possibly diminish the durability of the bed.

Bed frames are commonly fabricated from angle iron side rails and end rails, welded together in a square with one or more reinforcing pieces extending between the side rails. Springs or wires are strung between the rails to support a mattress. A mounting bracket adapted to hang on pins in each post of a headboard is riveted to a side rail at each corner of the bed frame. Frequently the joints between the mounting brackets and the side rails loosen under heavy use, leading to early failure of the bed frame.

SUMMARY OF THE INVENTION

These and other problems are solved by the present invention of a post for a bed comprising an elongated body having at least one channel sized to receive a pin channel where the elongated body is a segment of extruded material. The elongated body can have a second channel sized to receive a headboard. The first and second channels are preferably at a right angle to each other.

The elongated body can have a hollow channel, and it can have a cap on one end and coupler on the other end. Preferably, the cap and the coupler each have a boss that extends into the hollow channel.

In one aspect, the elongated body can have four channels at rights angles from each other and at least one channel is sized to receive a headboard. The extruded material can include aluminum and it can include a polymer.

In another aspect, the invention includes a coupler for a bed post of the type having one of a recess and a hollow channel. The coupler has a female side having a well sized that is shaped to receive an end of the bed post. The coupler can also have a male side having a boss sized to be snugly received within the recess or the hollow channel.

Preferably, the well is defined by walls that angle slightly outwardly. The coupler can have two female sides and it can be L shaped or T shaped or even cross shaped.

DETAILED DESCRIPTION

Figure 1:
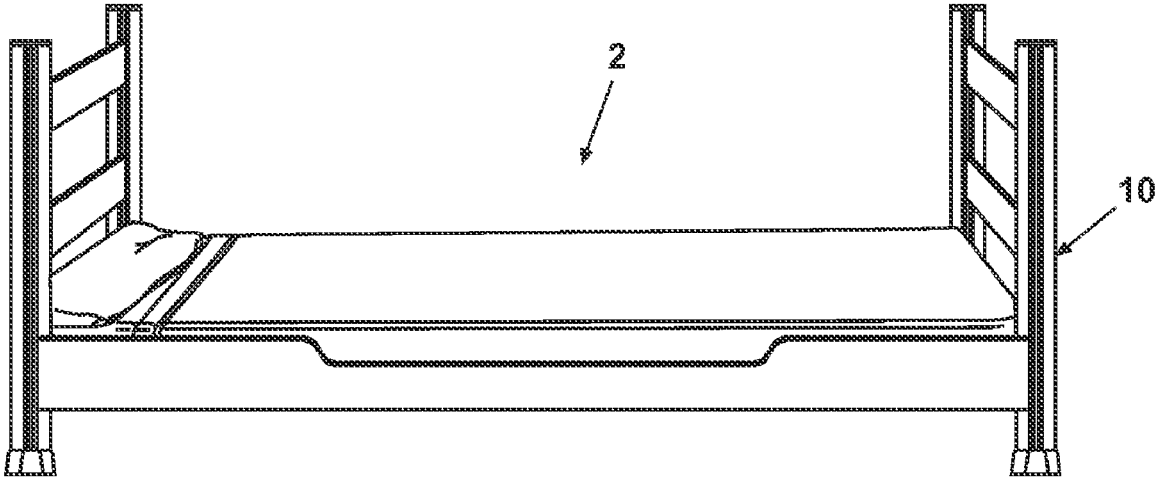
FIG. 1 is a side view of a bed incorporating a furniture post extrusion according to the invention.
Figure 2:
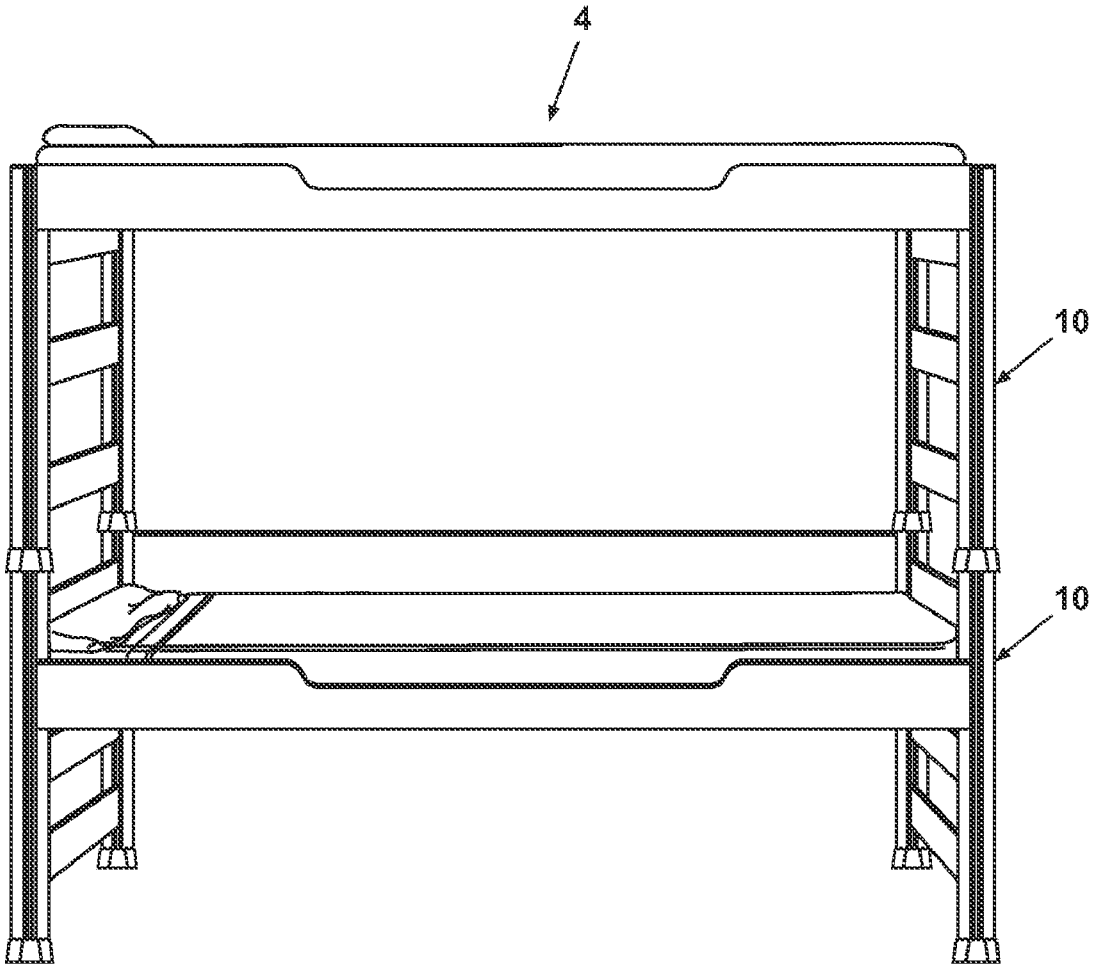
FIG. 2 is a side view of a bunk bed incorporating furniture post extrusions coupled together according to the invention.
Figure 3:
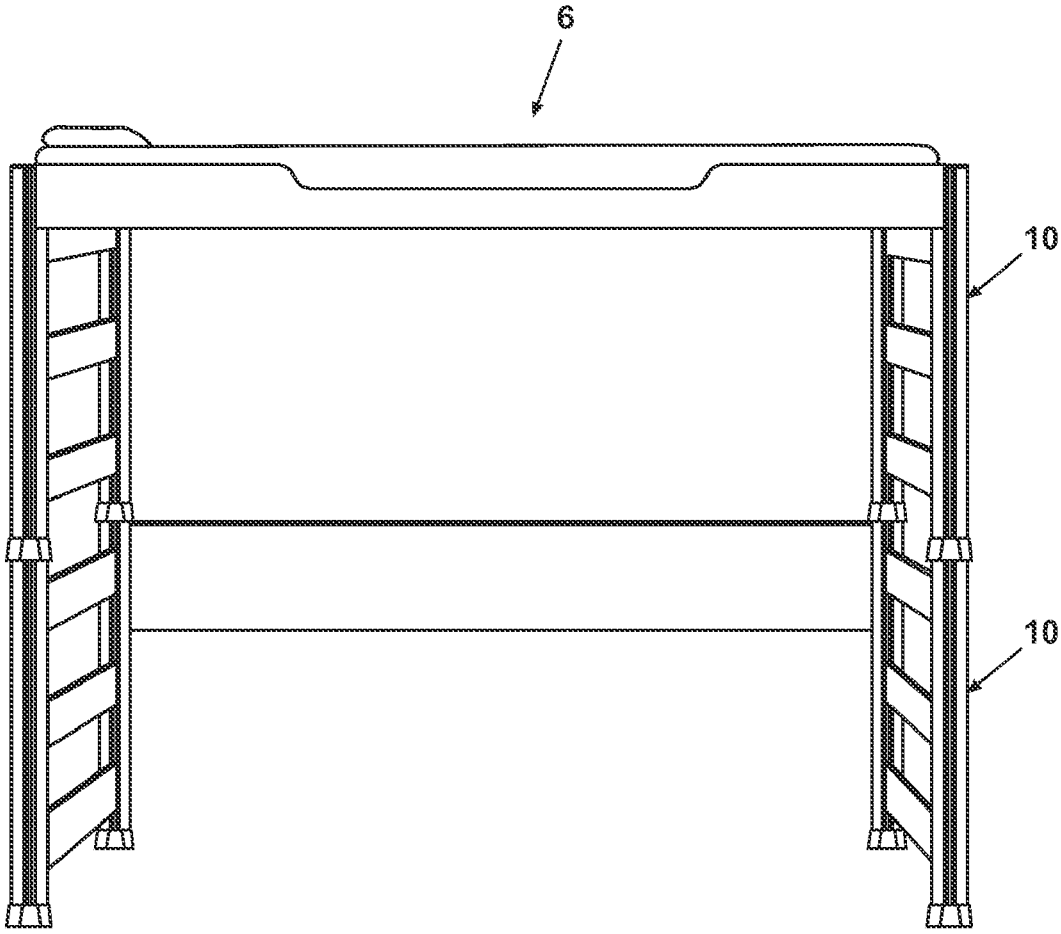
FIG. 3 is a side view of a raised bed incorporating a furniture post extrusion according to the invention.
Figure 4:
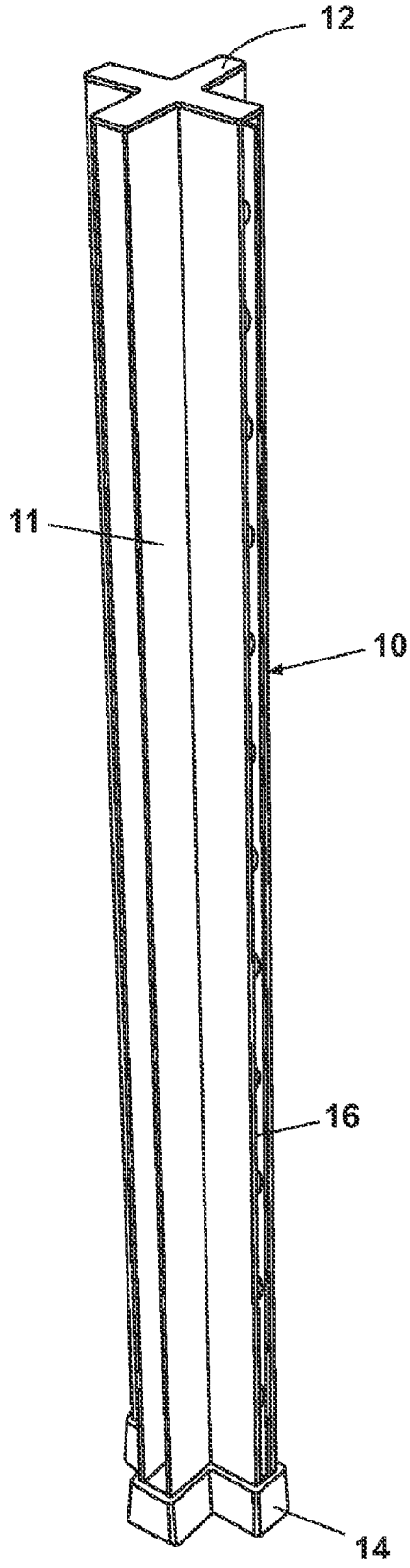
FIG. 4 is a perspective view of a furniture post extrusion according to the invention.

FIGS. 1, 2 and 3 show an environment where the invention may be used, i.e., a bed such as may be found in a university residence hall. FIG. 1 shows a typical bed 2, FIG. 2 shows a bunk bed 4, and FIG. 3 shows a raised bed 6, all of which incorporate furniture posts 10 according to the invention. It will be noted that a furniture post 10 according to the invention forms a bed post for each bed shown in FIGS. 1-3. An embodiment of a furniture post 10 according to the invention is illustrated in greater detail in FIGS. 4-6. It comprises an elongated body 11, with a cap 12 on one end, a coupler 14 on the other end, and at least one pin channel 16 mounted along one side. The elongated body 11 in this embodiment is an extruded segment with four "U-shaped" channels 17*a-d* extending outwardly and orthogonally from a hollow channel 19. The hollow channel 19 is generally a cruciform channel running the length of the elongated body 11. The furniture post 10 is preferably extruded of aluminum but may be made of any extrudable material such as a polymer or PVC.

Figure 6:
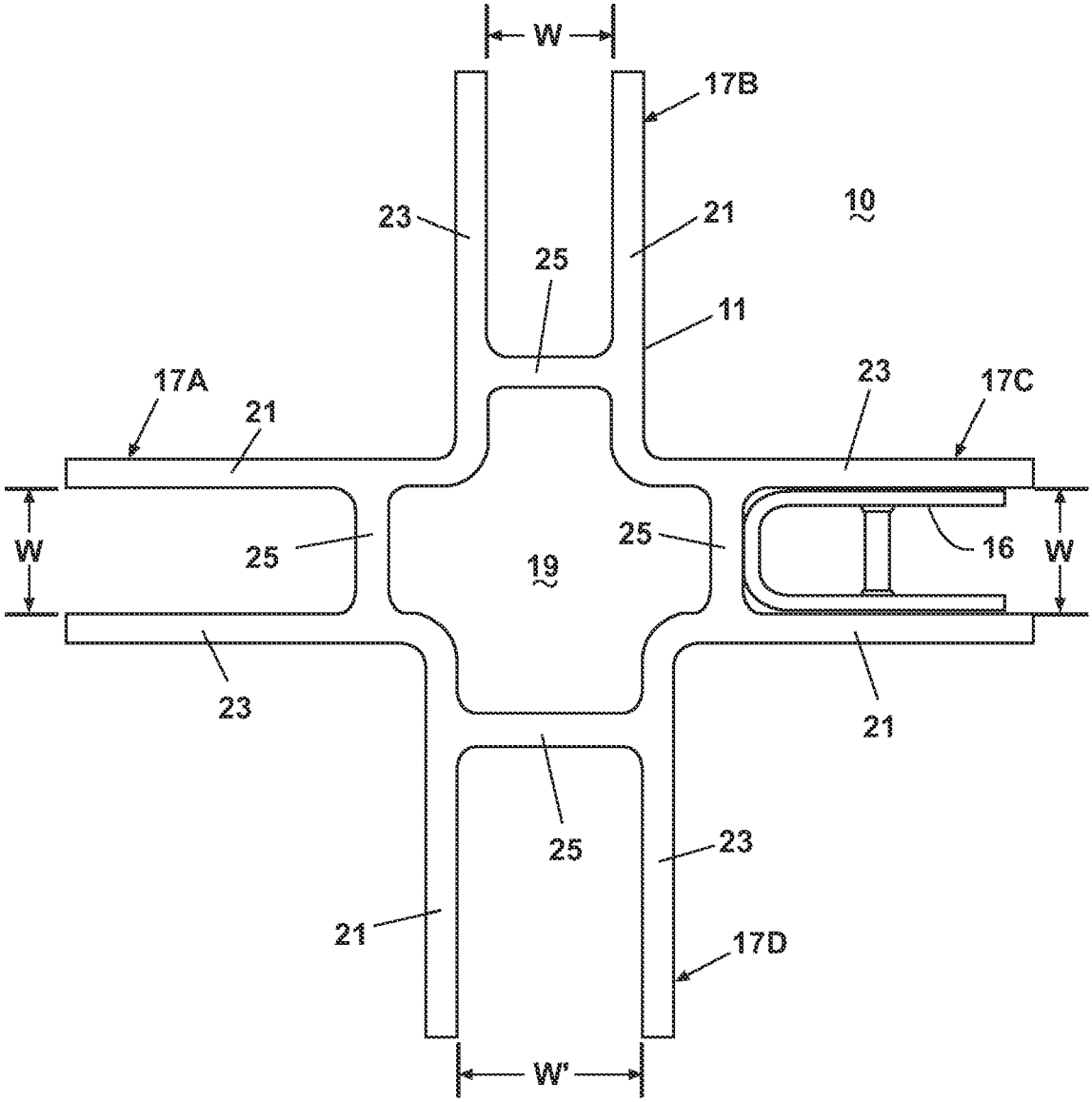
FIG. 6 is an end view of the furniture post extrusion of FIG. 5.

FIG. 6 shows an end view of the elongated body 11. It can be seen that each "U-shaped" channel 17*a-d* has two spaced arms 21, 23 that define a channel width W, and that that extend from a web 25 that defines, in part, the hollow channel 19. Three of the channels 17*a-c* have the same width W and the fourth 17*d* has a slightly larger width W'. The widths can be determined according to the purpose for which they are to be used. In the present embodiment, the three smaller "U-shaped" channels are dimensioned to hold the aforementioned pin channel 16 which nests within any of the smaller extruded channels 17*a-c*. Preferably, one or more score lines 18 are marked on the web 25 of each of the smaller "U-shaped" channels 17*a-c* into which a pin channel 16 may be inserted. The score lines 18 are made during the production of the elongated body 11 and serve to locate screws that will hold the pin channel 16 into place against the web 25. An exemplary pin channel 16 can be that found in co-owned patent application Ser. No. 60/827,540. Such a pin channel 16 will allow the height of various pieces of the furniture to be adjusted. The fourth larger "U-shaped" channel 17*d* is preferably dimensioned to receive a standard sized headboard or footboard such as might be made from ¾" stock.

Figure 5:
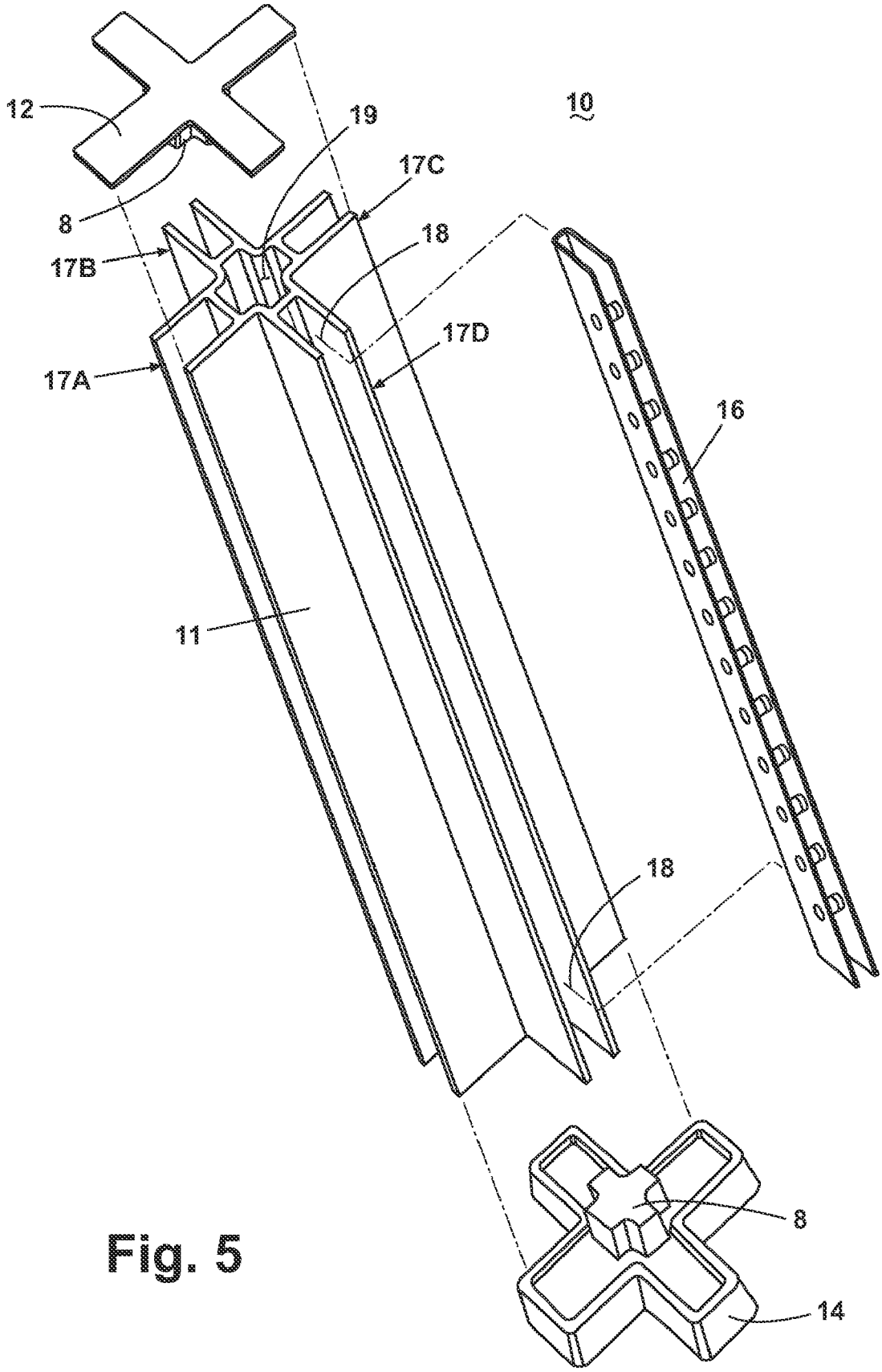
FIG. 5 is an exploded view of the furniture post extrusion of FIG. 4.

Looking more closely at FIG. 5, each of the cap 12 and the coupler 14 has a shape to match the cross sectional shape of the elongated body 11, which in this embodiment is a generally cruciform shape. The cap 12 and the coupler 14 each have a boss 8, preferably but not necessarily sized and shaped to be received within the hollow channel 19 at either end of the elongated body 11. The boss need only be sized and shaped to guide placement of the elongated body 11 relative to the coupler, and preferably, to assist holding it in place. Thus the boss 8 can have at least one cross sectional dimension nominally larger than a corresponding dimension in the hollow channel 19. The coupler 14 actually serves two primary functions, to-wit: it can act as the base or foot of the furniture post 10 or it can act as a coupler to couple two elongated bodies 11 together. Preferably the cap 12 and coupler 14 are both formed of a thermoplastic or other moldable material, such as by injection molding. Further, the cap 12 is sized to be received within the coupler 14.

Figure 7:
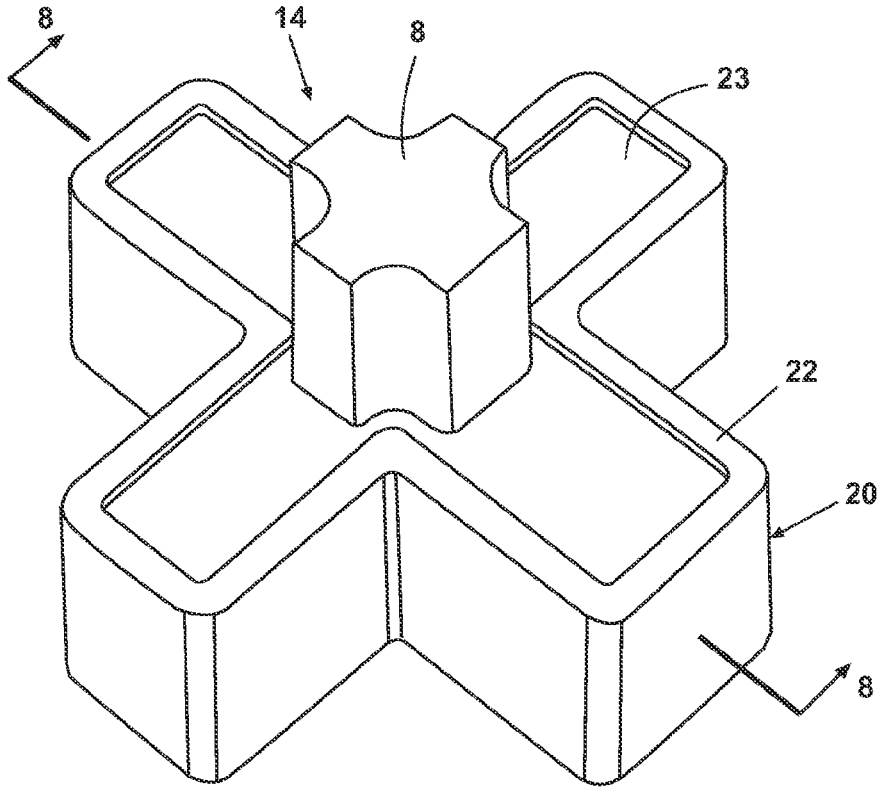
FIG. 7 is a perspective view of the coupler in the furniture post extrusion of FIG. 4.
Figure 8:
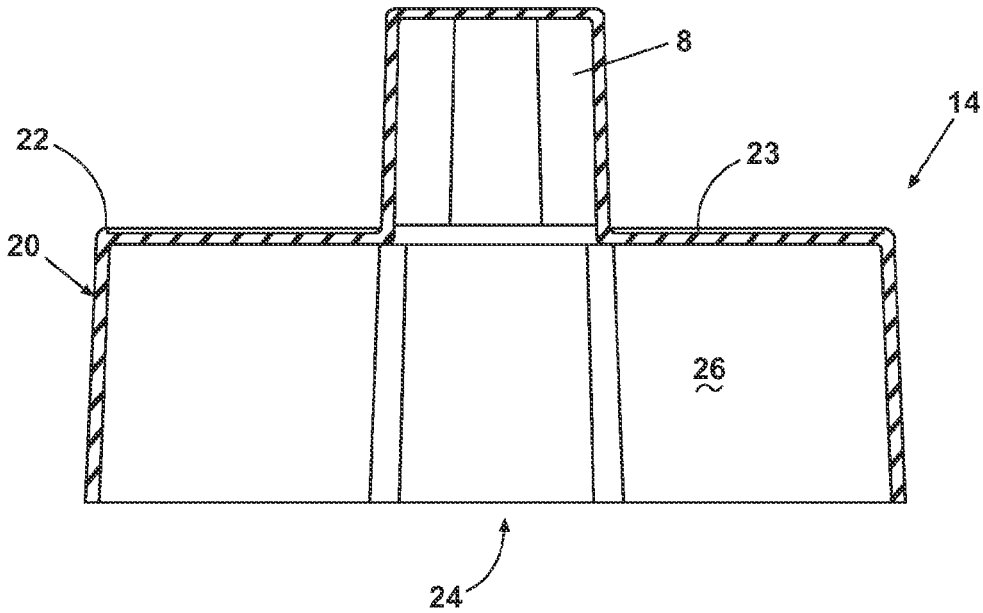
FIG. 8 is a cross sectional view taken along line 8-8 of FIG. 7.
Figure 9:
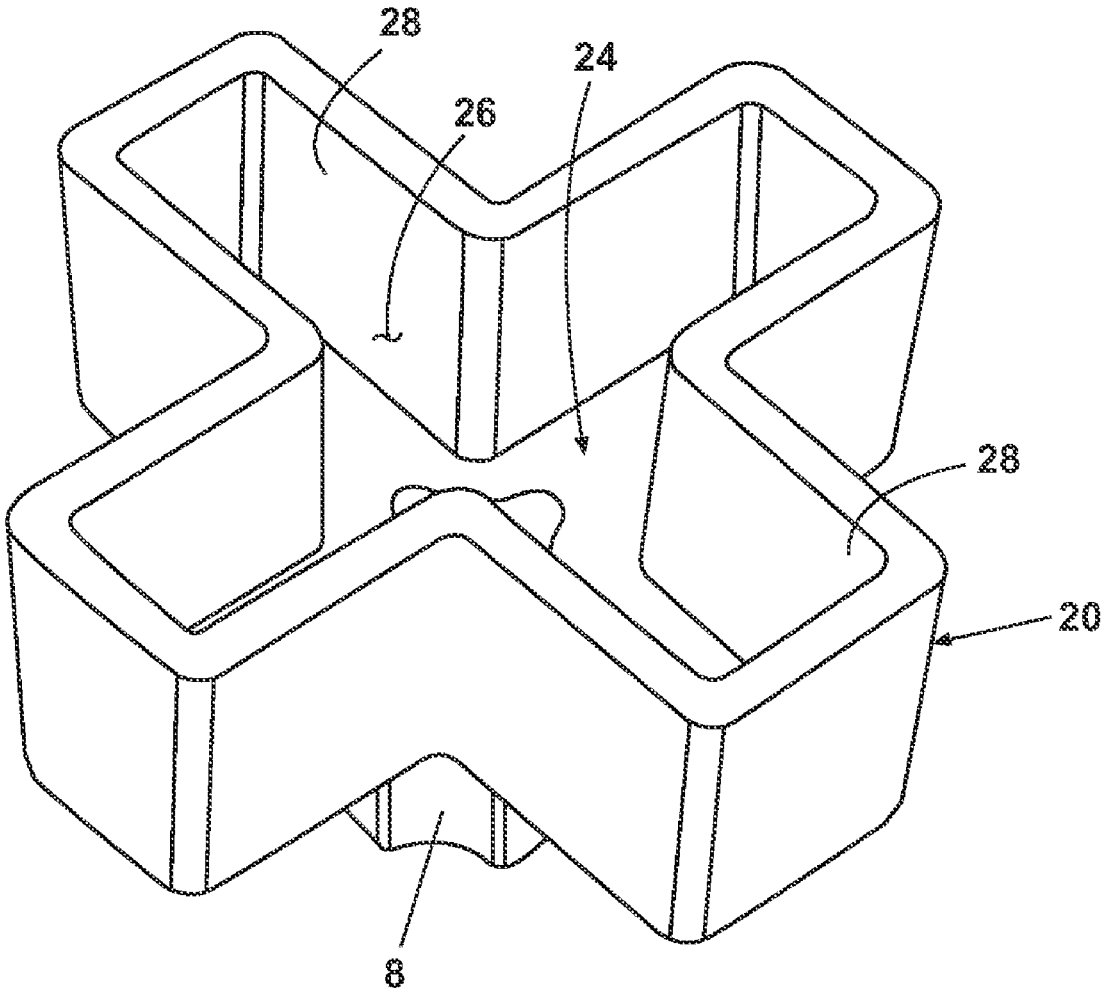
FIG. 9 is a bottom perspective view of the coupler of FIG. 7.

FIGS. 7-9 show the coupler 14 in greater detail. The coupler 14 comprises a male side 20 from which the boss 8 extends. A ridge 22 runs along the periphery of the top surface 27 of the male side 20. The upper surface 27 and ridge 22 are sized so that the elongated body 11 rests on the upper surface within the ridge 22. The cruciform boss 8, when received in the hollow channel 19, also helps to hold the elongated body 11 in place. In this way, the elongated body 11 can be supported by the coupler 14 as a foot or a base.

FIG. 9 and the cross sectional view shown in FIG. 8 show that the coupler 14 also has a female side 24 which comprises a well 26 sized and shaped to receive the elongated body 11. The walls 28 of the female side 24 are preferably slightly angled outwardly so that when the female side 24 couples with the elongated body 11, it fits easily and is held in place.

It will be understood that the elongated body 11 need not be cruciform in shape to accomplish its intended functions. For example, the elongated body 11 can be L-shaped, where one channel is dimensioned to receive a pin channel and the other channel is dimensioned to receive a headboard or footboard.

Figure 10:
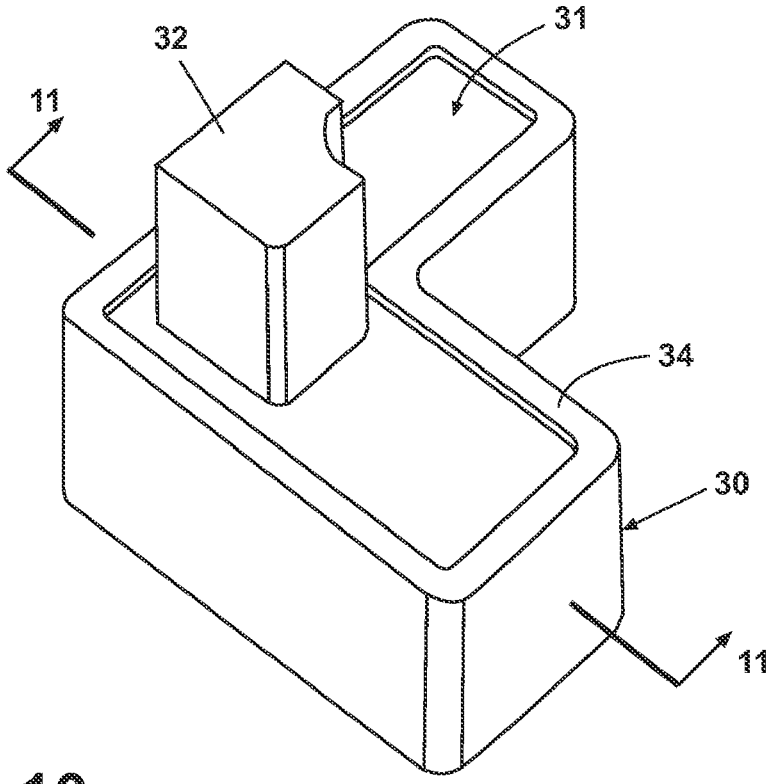
FIG. 10 is a perspective view of a second embodiment of a coupler according to the invention.
Figure 11:
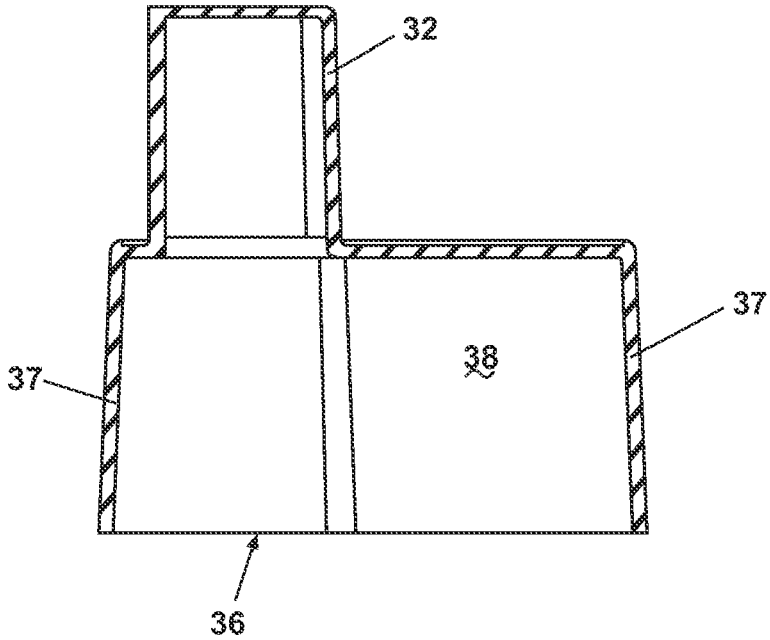
FIG. 11 is a cross sectional view taken along line 11-11 of FIG. 10.

FIGS. 10 and 11 show a second embodiment of a coupler 30 in an "L-shaped" configuration adapted to accommodate an "L-shaped" elongated body. This coupler 30 also contains on a male side 31 an "L-shaped" boss 32, and an "L-shaped" ridge 34 to hold the elongated body 11 in place when acting as a base or foot. FIG. 11 shows that the "L-shaped" coupler 30 also has a female side 36 with slightly angled walls 37 defining a well 38 shaped and dimensioned to receive an "L-shaped" furniture post when acting as a coupler.

Figure 12:
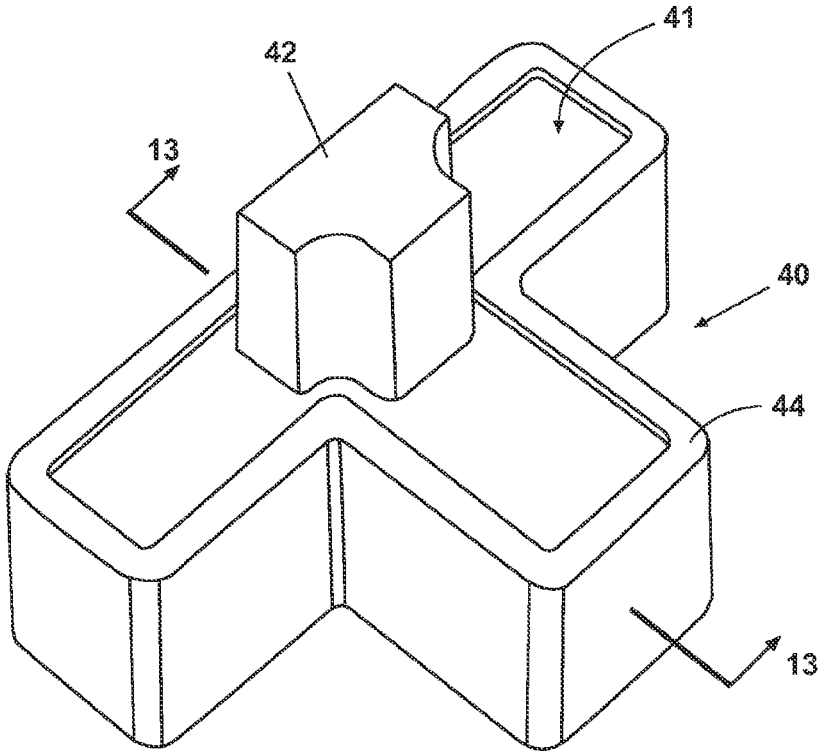
FIG. 12 is a perspective view of a third embodiment of a coupler according to the invention.
Figure 13:
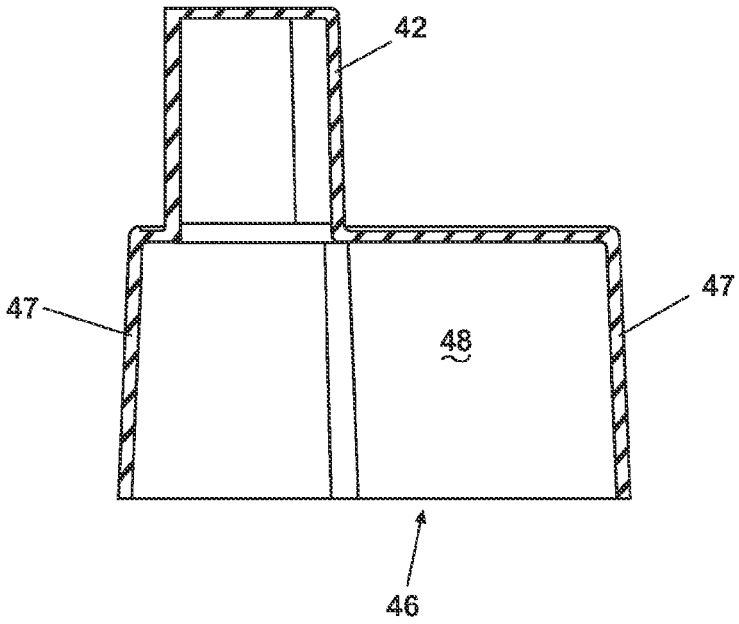
FIG. 13 is a cross sectional view taken along line 13-13 of FIG. 12.

FIGS. 12 and 13 show a third embodiment of the coupler 40 in a "T-shaped" configuration which would work with a "T-shaped" furniture post. This coupler 40 also contains o a male side 41 a "T-shaped" boss 42, and "T-shaped" ridge 44 to hold the furniture post in place. FIG. 13 shows that the "T-shaped" coupler 40 also has a female side 46 with slightly angled walls 47 to define a well 48 that can receive a "T-shaped" furniture post.

Figure 14:
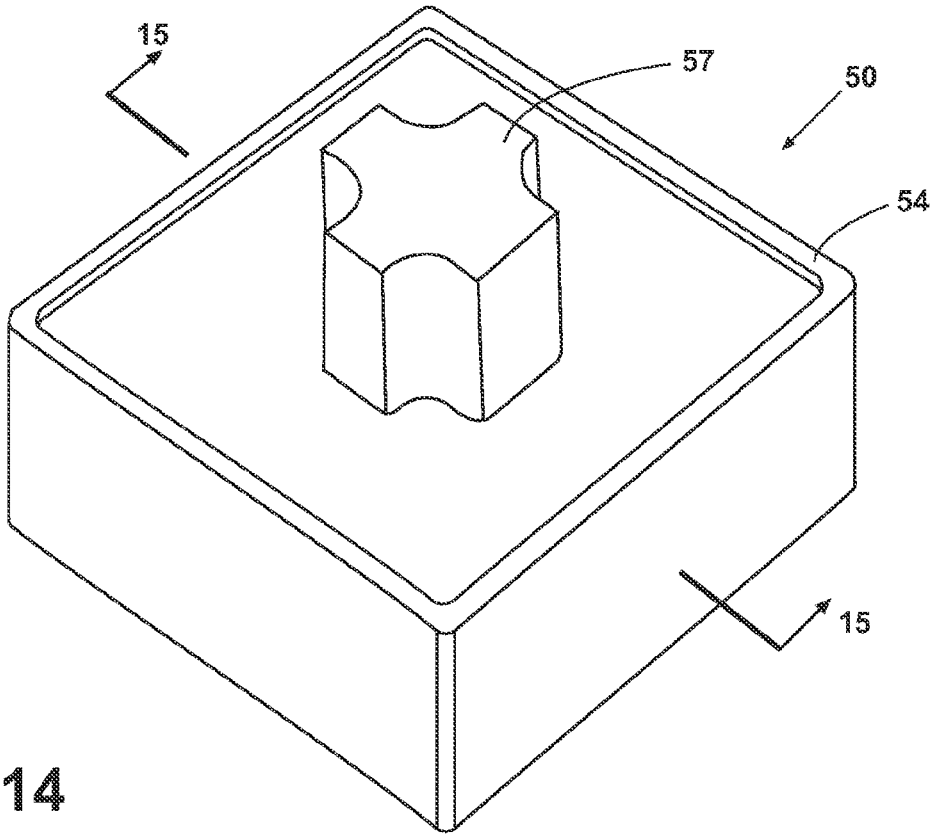
FIG. 14 is a perspective view of a fourth embodiment of a coupler according to the invention.
Figure 15:
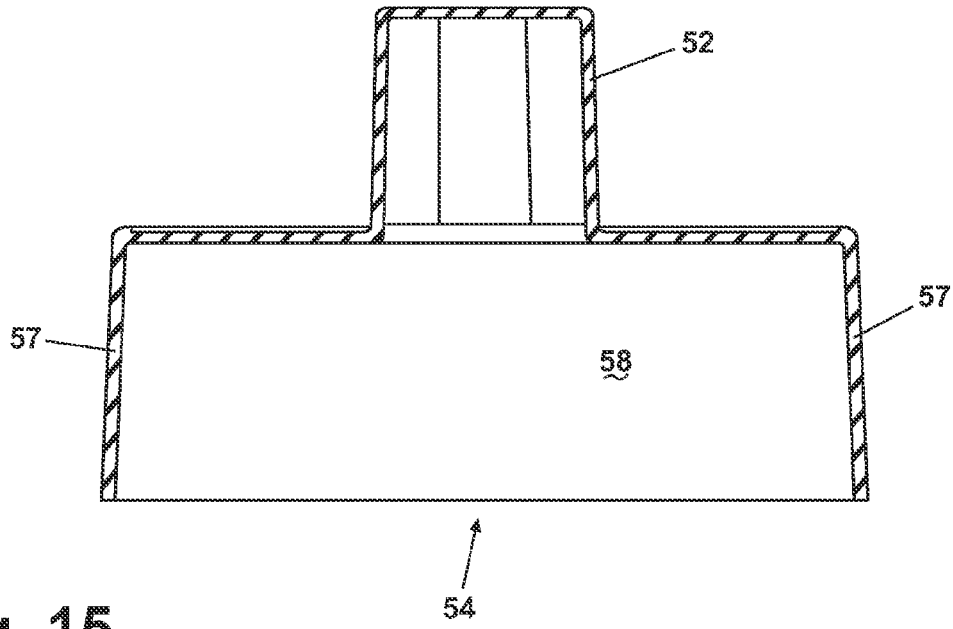
FIG. 15 is a cross sectional view taken along line 15-15 of FIG. 14.

It will be understood that the coupler is not limited to use with an extruded segment as described above. It can be easily adapted to work with a more conventional furniture post. FIGS. 14 and 15 show a fourth embodiment of the coupler 50 adapted to accommodate a conventional wooden furniture post. This coupler 50 will preferably have a simpler shaped boss adapted to be received in a recess in the post for centering the post and holding it in place on the coupler. Of course, the boss can be any shape, such as the aforementioned cruciform boss 52. Preferably, a ridge 54 extends along the periphery to hold the wooden post in place. FIG. 15 shows that the coupler 50 also has a female side 56 with slightly angled walls 57 defining a well 58 to receive a wooden post.

Figure 16:
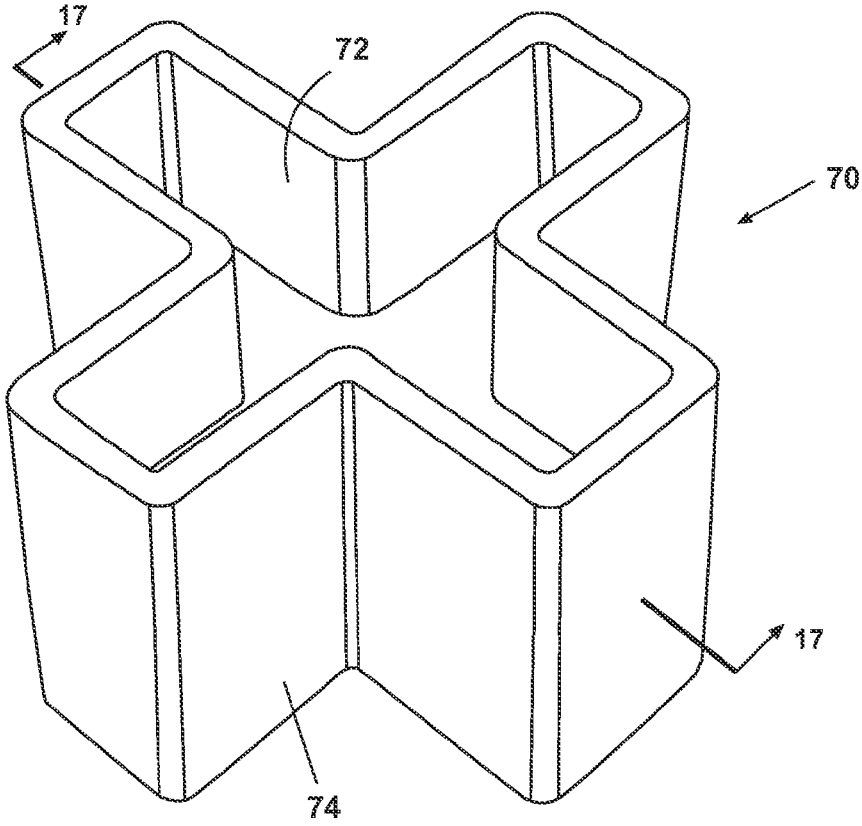
FIG. 16 is a perspective view of a fifth embodiment of a coupler according to the invention.
Figure 17:
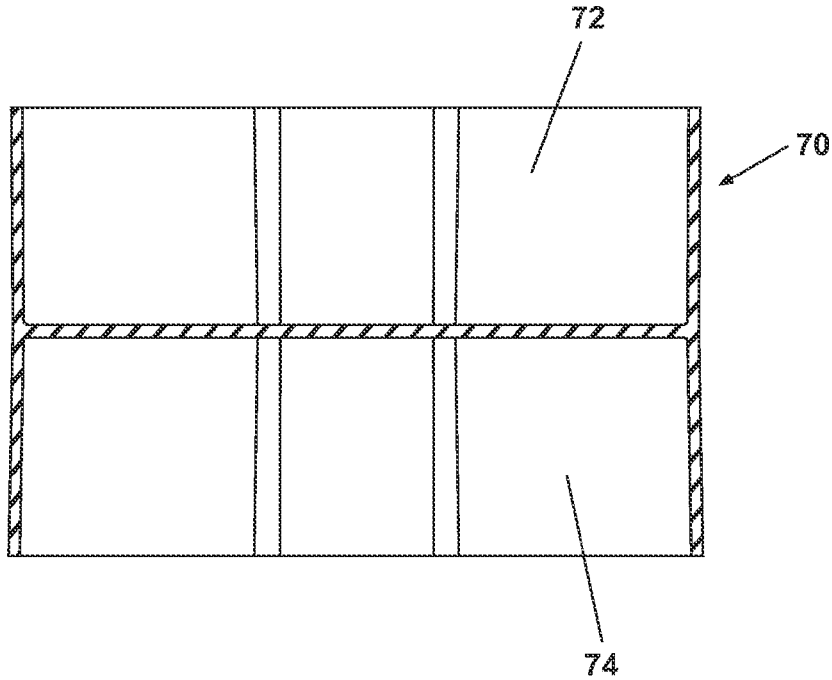
FIG. 17 is a cross sectional view taken along line 17-17 of FIG. 16.

FIGS. 16 and 17 show a fifth embodiment of the coupler 70 in a cross shaped configuration which would work with a cross shaped furniture post 10. This coupler 70 contains two female sides 72 and 74 into each of which a cross shaped furniture post 10 may be inserted. FIG. 17 shows that both female sides 72 and 74 have walls that are slightly angled to receive a cross shaped furniture post 10 easily and hold it in place.

Figure 18:
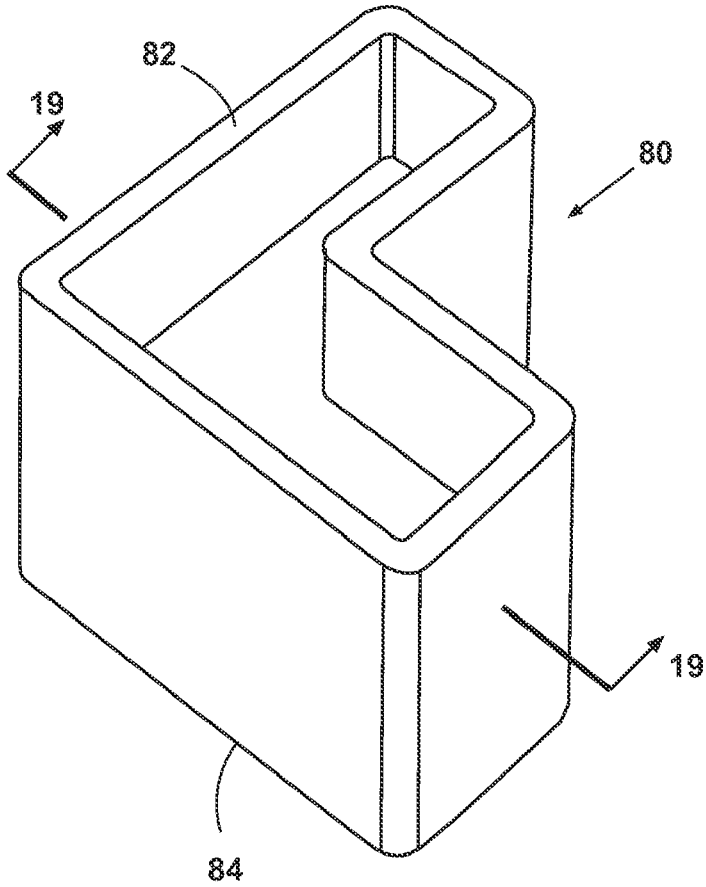
FIG. 18 is a perspective view of a sixth embodiment of a coupler according to the invention.
Figure 19:
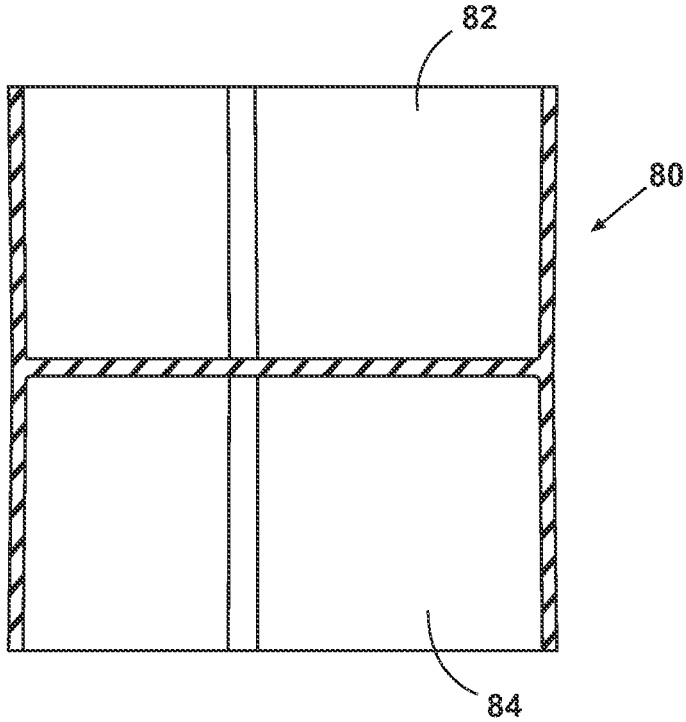
FIG. 19 is a cross sectional view taken along line 19-19 of FIG. 18.

FIGS. 18 and 19 show a sixth embodiment of the coupler 80 in an "L-shaped" configuration which would work with an "L-shaped" furniture post. This coupler 80 contains two female sides 82 and 84 into each of which an "L-shaped" furniture post may be inserted. FIG. 19 shows that both female sides 82 and 84 have walls that are slightly angled to receive an "L-shaped" furniture post easily and hold it in place.

Figure 20:
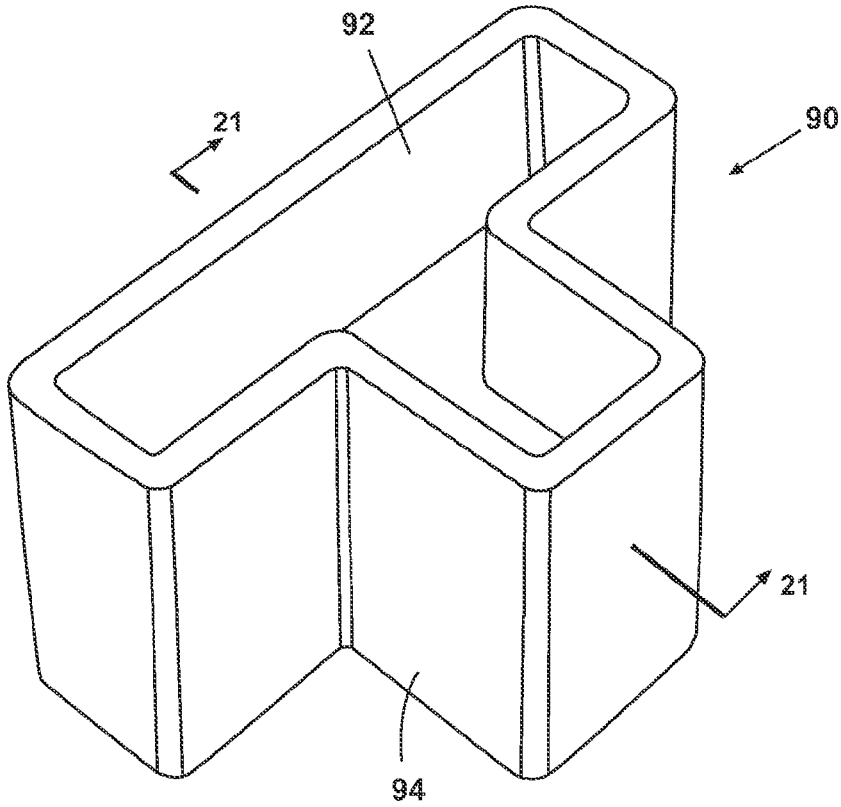
FIG. 20 is a perspective view of a seventh embodiment of a coupler according to the invention.
Figure 21:
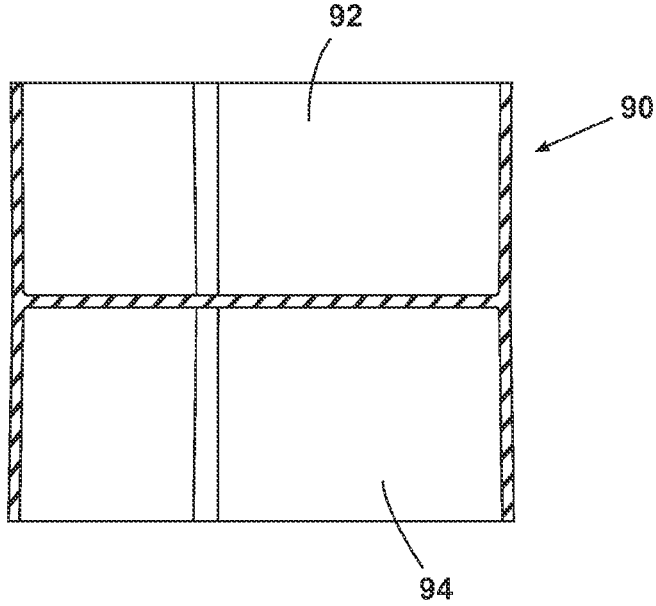
FIG. 21 is a cross sectional view taken along line 21-21 of FIG. 20.

FIGS. 20 and 21 show a seventh embodiment of the coupler 90 in a "T-shaped" configuration which would work with a "T-shaped" furniture post. This coupler 90 contains two female sides 92 and 94 into which a "T-shaped" furniture post may be inserted. FIG. 21 shows that both female sides 92 and 94 have walls that are slightly angled to receive a "T-shaped" furniture post easily and hold it in place.

Figure 22:
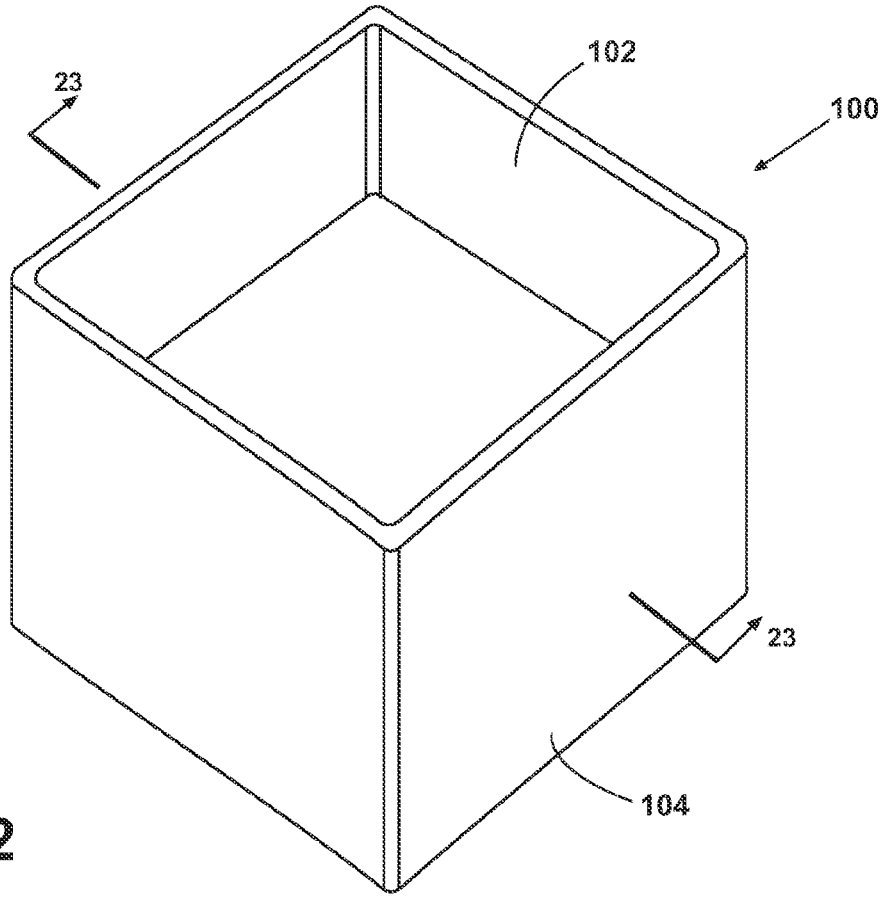
FIG. 22 is a perspective view of an eighth embodiment of a coupler according to the invention.
Figure 23:
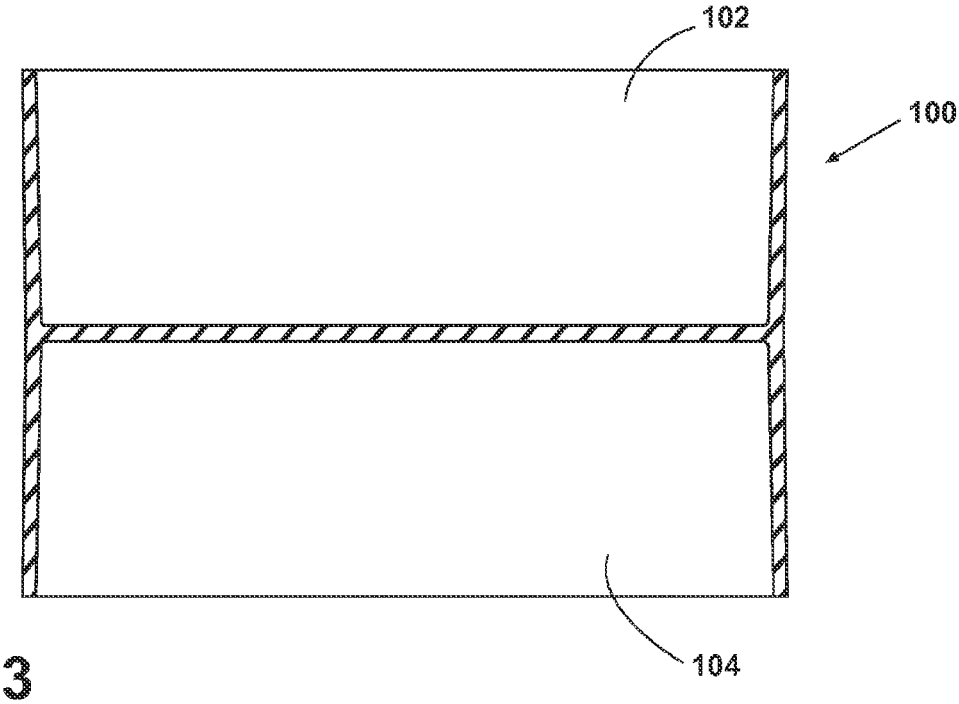
FIG. 23 is a cross sectional view taken along line 23-23 of FIG. 22.

FIGS. 22 and 23 show an eighth embodiment of the coupler 100 meant to work with a conventional wooden post which is not extruded. This coupler 100 contains two female sides 102 and 104 into which a wooden post may be inserted. FIG. 23 shows that both female sides 102 and 104 have walls that are slightly angled to receive a wooden post easily and hold it in place.

While the invention has been specifically described in connection with certain specific embodiments thereof, it is to be understood that this is by way of illustration and not of limitation, and the scope of the appended claims should be construed as broadly as the prior art will permit.

What is claimed is:

1. A post for a bed comprising:

an elongated body having a hollow channel and at least one U-shaped channel along its length where the U-shaped channel is defined by:

a first arm, a second arm generally parallel to and spaced from the first arm, and a web extending between the first and second arms, a cap having a boss that extends into the hollow channel on one end of the elongated body, and a coupler having a boss that extends into the hollow channel on the other end of the elongated body, wherein the at least one U-shaped channel is sized to receive a U-shaped pin channel, having a shape similar to the at least one U-shaped channel, in a closely nested relationship such that when the U-shaped pin channel is received within the U-shaped channel it extends along the length of the U-shaped channel and wherein the elongated body is a segment of extruded material.

2. The post of claim 1 wherein the at least one channel is a first channel and the elongated body comprises a second channel configured to receive a headboard.

3. The post of claim 2 wherein the first and second channels are at a right angle to each other.

4. The post of claim 1 wherein the extruded material comprises aluminum.

5. The post of claim 1 wherein the extruded material comprises a polymer.

6. A post for a bed comprising:

an elongated body having four channels along its length at right angles from each other, where at least one channel is sized to receive a headboard and at least one channel is U-shaped and where the U-shaped channel is defined by:

a first arm, a second arm generally parallel to and spaced from the first arm, and a web extending between the first and second arms, wherein the at least one U-shaped channel is sized to receive a U-shaped pin channel, having a shape similar to the at least one U-shaped channel, in a closely nested relationship such that when the U-shaped pin channel is received within the U-shaped channel it extends along the length of the U-shaped channel and wherein the elongated body is a segment of extruded material.

7. The post of claim 6 wherein each of the four channels extends from a center to define a cruciate cross section.

8. The post of claim 6 wherein the extruded material comprises aluminum.

9. The post of claim 6 wherein the extruded material comprises a polymer.

10. The post of claim 6 wherein the elongated body has a hollow channel.

11. The post of claim 10 further comprising a cap on one end and coupler on the other end.

12. The post of claim 11 wherein the cap and the coupler each have a boss that extends into the hollow channel.

* * * * *